United States Patent [19]

Felts et al.

[11] Patent Number: 4,773,202

[45] Date of Patent: Sep. 27, 1988

[54] PORTABLE NEWSPAPER FOLDING AND BAGGING SYSTEM

[75] Inventors: Rodney D. Felts, Burlington; James R. Hartsoe, Greensboro; Wayne C. Thomas, Kernersville, all of N.C.

[73] Assignee: IPI Industries, Inc., Greensboro, N.C.

[21] Appl. No.: 79,093

[22] Filed: Jul. 29, 1987

[51] Int. Cl.[4] ..... B65B 9/02; B65B 63/04

[52] U.S. Cl. ..... 53/429; 53/120; 53/229; 53/450; 53/463; 53/555

[58] Field of Search ..... 53/116, 120, 228, 229, 53/429, 450, 451, 463, 466, 548, 553, 554, 555, 390, 393, 117

[56] References Cited

U.S. PATENT DOCUMENTS

| | | | |
|---|---|---|---|
| 2,541,387 | 2/1951 | Salfisberg | 53/429 |
| 3,465,492 | 9/1969 | Jensn | 53/555 X |
| 3,686,820 | 8/1972 | Zenger et al. | 53/555 X |
| 3,691,721 | 9/1972 | Hannon et al. | 53/120 |
| 4,021,993 | 5/1977 | Widmer | 53/120 |
| 4,423,584 | 1/1984 | Elsner et al. | 53/279 X |

FOREIGN PATENT DOCUMENTS

| | | | |
|---|---|---|---|
| 2345151 | 3/1975 | Fed. Rep. of Germany | 53/429 |

*Primary Examiner*—James F. Coan
*Assistant Examiner*—Steven P. Weihrouch
*Attorney, Agent, or Firm*—C. Robert Rhodes; Judith E. Garmon

[57] ABSTRACT

Method and apparatus, to be utilized by a newspaper carrier on a "vehicle route," for mechanically folding and bagging newspapers and like articles. A continuous length of heat-sealable polymeric film, wider than the newspaper or other article, is arranged along a generally horizontal feed path to form a folding station. The newspaper or like article is fed to the folding station of apparatus in parallel overlying relation to the film. A vertically reciprocal, motorized folder bar extends transversely across and above the film at a point substantially centrally located in the folding station. The folder bar is movable between an upper position above the feed path and a lower position below the feed path where there is formed a pouch of film surrounding the folded newspaper. A pair of opposed heated sealing frames having top and side members are pivotally mounted and movable, responsive to the return upward movement of the folder bar, between an open receiving position and a closed clamping position in sealing engagement with the opposed top and side marginal portions of the film. A cutting blade extends along at least one of the upper frame members intermediate the upper and lower edges thereof to sever the film above the newspaper and to simultaneously reform the continuous length of film. The housing for the apparatus is adapted to be supported in a position between the front edge of the front seat and the dash.

7 Claims, 5 Drawing Sheets

FIG. 3
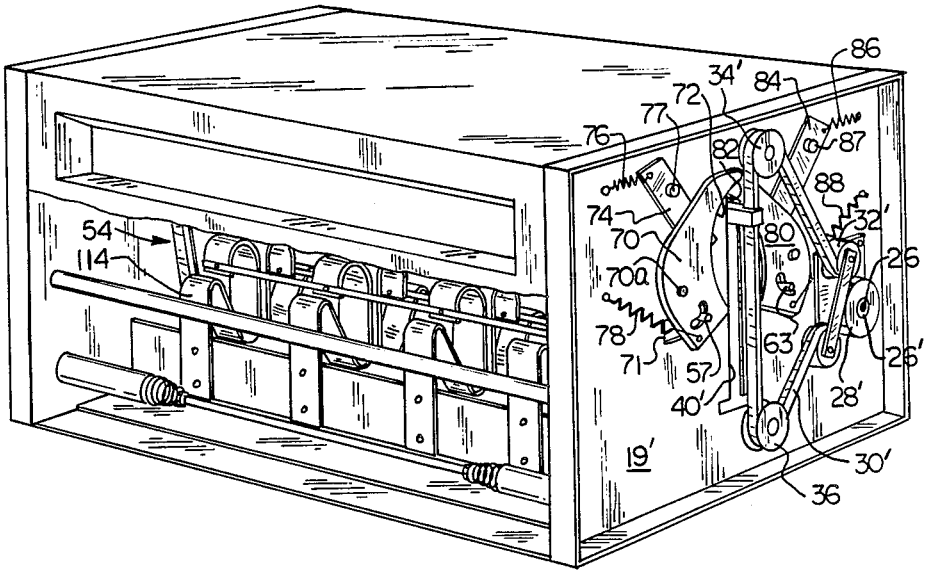
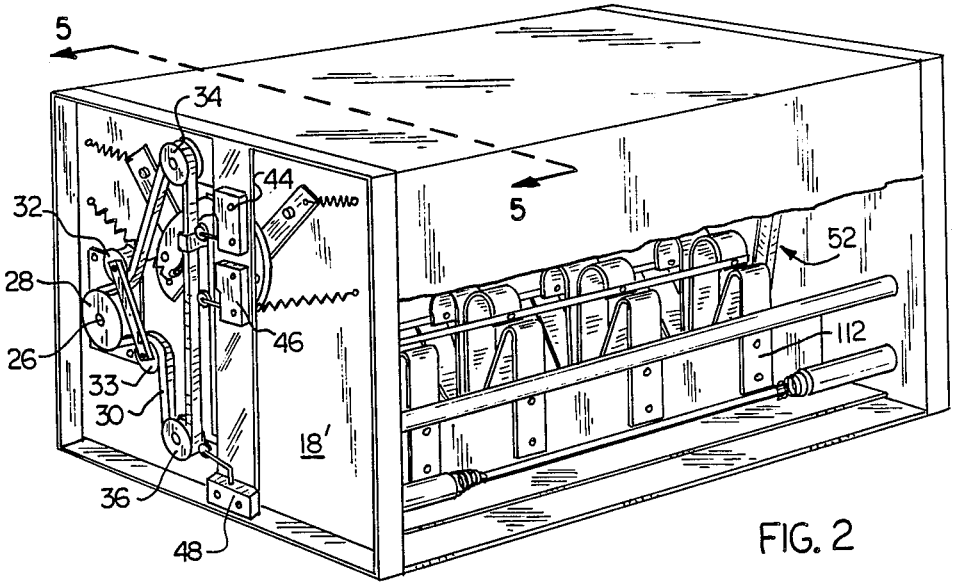
FIG. 2

PORTABLE NEWSPAPER FOLDING AND BAGGING SYSTEM

BACKGROUND AND SUMMARY OF THE PRESENT INVENTION

The present invention relates to folding and bagging devices, and more particularly to a method and apparatus for folding newspapers and like articles and mechanically placing them in heat-sealable polymeric film bags.

In order to understand the background of the present invention some review of the evolution of newspaper delivery techniques might prove helpful. In early days newsboys sold newspapers on street corners or at newsstands. As a matter of convenience, newspaper publishers subsequently began to provide home delivery of newspapers. At the outset news carriers carried papers by hand or by bicycle to residential homes. It was customary for the news carriers to fold their papers prior to delivery and place 50–80 papers in conventional newspaper bags so that papers for a route could be carried at once and tossed for a short distance onto the porch of the customer. In inclement weather the news carriers had to be careful to place the newspapers on a covered porch or behind a door to prevent the paper from getting wet. Despite all their efforts, however, the newspapers of many subscribers still managed to get wet and were unreadable. Such instances caused complaints with the newspaper office and an expensive system of delivering replacement newspapers was necessary.

With the advent of polymeric films, in threatening or inclement weather news carriers began to roll the papers and place them in polymeric bags. This was satisfactory for some time, and did prevent or at least minimize the number of papers which were completely unreadable and had to be replaced. Still, this system proved to be quite an improvement over unprotected papers.

More recently, however, newspaper companies have been replacing news carriers who had walking or bike routes with larger routes which are serviced by older persons. These routes are referred to as "vehicle routes." The difference between these routes and the smaller routes customarily handled by boys on foot or on bikes is the size of the route. Such vehicle routes have several hundred papers; in fact, it is customary for the delivery persons of vehicle routes to completely fill their car with newspapers in the flat or unfolded condition. It is impossible to prefold or prebag all of the papers because they are too bulky and take up too much room. Thus, large prefolding and bagging machines which are available at some newspaper offices are not compatible with such a system because the delivery person simply cannot carry all of the folded and bagged papers in his or her automobile.

Thus, it has become customary for the delivery person to fill his car with unfolded papers and fold papers while the vehicle is moving from house to house in order to keep a supply of papers on the floor of the front seat on the passenger side. In fair weather, the papers are secured in the folded position with a rubber band. However, in inclement or threatening weather, the newspapers must be folded and placed in a polymeric bag. The bag is open at one end and sometimes the paper slides out of the bag, or moisture gets in the bag and the paper becomes wet. In any event, the procedure for folding and bagging papers while driving is extremely dangerous and newspaper companies would like to discourage such practices.

It is in this environment that the inventors of the present invention saw a need for a portable folding and bagging apparatus that could be positioned on the front seat beside the driver on or in front of the passenger side. It was envisioned that with such an apparatus the delivery person could merely feed newspapers into the apparatus where they would be folded and bagged mechanically and dropped onto the floor of the front seat in front of the passenger side. In order to power such a machine it was determined that the apparatus would preferably be operated from a 12 volt battery source so that the device could be connected to the cigarette lighter, much in the manner of small vacuums, television, electric razors, and other appliances which are now utilized with automobiles. Since the apparatus was to be operated from a 12 volt source, it would have to be compact, simply operated, not requiring large voltage sources.

Therefore, in general, the method and apparatus of the present invention is directed to a system whereby there is provided a housing with top, bottom, and side walls. An inlet is positioned adjacent the top portion of the housing and there is provided an outlet in the bottom wall. The housing is positioned in the front portion of the vehicle between the edge of the front seat and the dash so that the outlet from the housing directs folded and bagged newspapers onto the floor on the passenger side thereof. Within the housing there is a mechanism for folding the newspaper within a polymeric film pouch, clamping the edges of the pouch together, heat sealing the edges, and severing the bagged newspaper from the remainder of the polymeric film.

More particularly, the apparatus includes opposed supply rolls carrying a continuous length of heat-sealable polymeric film therebetween; the rolls being spaced apart and wider than the newspapers or other paper articles to be wrapped. The continuous length of film extends from one supply roll, around the outside of an idler roll, along a generally horizontal feed path in upper portion of the housing, around the outside of the other idler roll, and back around the other supply roll. The horizontal portion of the feed path forms a folding station. A vertically reciprocal folder bar extends transversely across and above the length of film at a point substantially centrally located at the folding station. The folder bar is movable between an upper position above the continuous length of film and a lower position below the continuous length of film where there is formed a pouch of film having open sides and top and surrounding a folded newspaper.

A pair of spaced opposed sealing frames having side and top members are pivotally mounted at the lower end of the side members and movable, responsive to the upward movement of the folder bar, between an open position and a closed, clamping position in sealing engagement with the side and top marginal portions of the film. A drive motor is activated once the newspaper reaches the folding station to begin the downward, folding movement of the folder bar, at the completion of which the motor is reversed to drive the folder bar upwardly. When the folder bar reaches its uppermost position the sealing operation begins.

The aforesaid sealing frames are heated electrically or the like. A heated cutting blade extends across the top member of the frame intermediate the upper and lower edges thereof for effecting a severance of the heated film above the newspaper, and simultaneously reforming the continuous length of film for the next operation. Upon completion of the serving operation the folded, bagged newspaper falls out the bottom of the apparatus, and the continuous film is reformed at the folding station ready for the receipt of another paper. The entire operation takes merely a matter of 5-10 seconds.

So arranged, the delivery person merely keeps a stack of unfolded papers on the front seat adjacent the folding and bagging apparatus. Newspapers can be fed into the apparatus and retrieved from the floor beneath the apparatus without requiring distraction of the driver from the road ahead.

The apparatus is simplified by virtue of there being a single motor operated from a 12 volt DC source. The movement of the folder bar causes the simultaneous folding of the newspaper about a longitudinal axis and a folding of the film in surrounding relation thereto. The return upward movement of the folder bar then activates a cam system which urges the normally open sealing frames into closed, clamping relationship. The slight return of the folder bar from its uppermost position then releases the clamping frames so that the folded, bagged newspaper is free to fall through the exit slot.

To the knowledge of the applicant, there are no devices in the prior art which are sufficiently simple and compact as to be utilized in the environment for which the present invention is envisioned. Examples of large apparatuses which may be utilized as part of the newspaper manufacturing process in the newspaper plant are illustrated and described in U.S. Pat. Nos. 3,060,658 to Horsting, 4,021,993 to Widmer; 3,161,000 to Hannon et al.; and 4,189,134 to Mills et al. These devices are all relatively large, complicated, and expensive. Another example of a device for folding and bagging a paper-like product is illustrated in U.S. Pat. No. 3,439,469 to Van Mil, Jr.; however, this is not a newspaper or similar article, and the components and operative process is substantially different.

It is therefore an object of the present invention to provide a relatively simple, compact, and inexpensive folding and bagging system for newspapers and like articles, which may be implemented by the newspaper carrier with the apparatus placed on the automobile seat beside him.

It is another object of the present invention to provide a device of the type described which is mechanically operated and powered by a 12 volt battery source so that it may be activated by electrically connecting the apparatus to the cigarette lighter of a vehicle.

Yet another object of the present invention is to provide a method and apparatus of the type described in which all internal movements are initiated by a single 12 volt drive mechanism, the remainder of the mechanical operation of the device being set in motion and operated by movement of a folder bar.

Other objects and a fuller understanding of the invention will become apparent from reading the following detailed description of a preferred embodiment in conjunction with the accompanying drawings in which:

FIG. 2 is a perspective view of the apparatus looking from the front left side with all cover plates removed;

FIG. 3 is a perspective view looking at the front right side with all cover plates removed;

Figure 7:
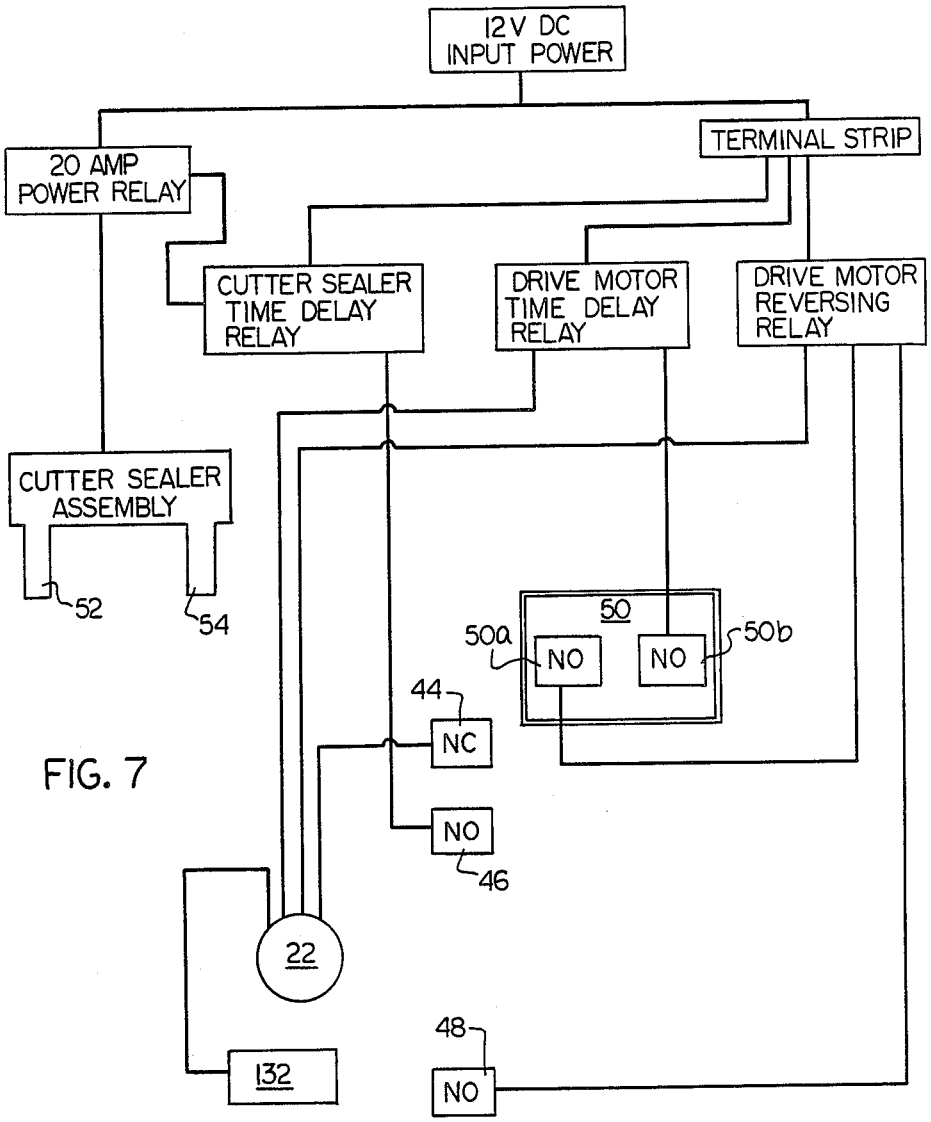

FIG. *6a* is a side schematic view illustrating the folder bar in the ready position;

FIG. *6b* is a side schematic view illustrating the folded bar in the lowermost position;

FIG. *6c* is a schematic view with the folder bar in the uppermost position and the sealing frames closed; and FIG. 7 is an electrical schematic illustrating the control system for the present invention.

DETAILED DESCRIPTION OF A PREFERRED EMBODIMENT

It should first be understood that the ensuing detailed description of a preferred embodiment will be described with reference to the folding and wrapping of a conventional newspaper, however, those skilled in the art will easily understand that the method and apparatus is equally applicable for use in folding and bagging other types of flat paper goods such as magazines and other periodicals.

Figure 1:
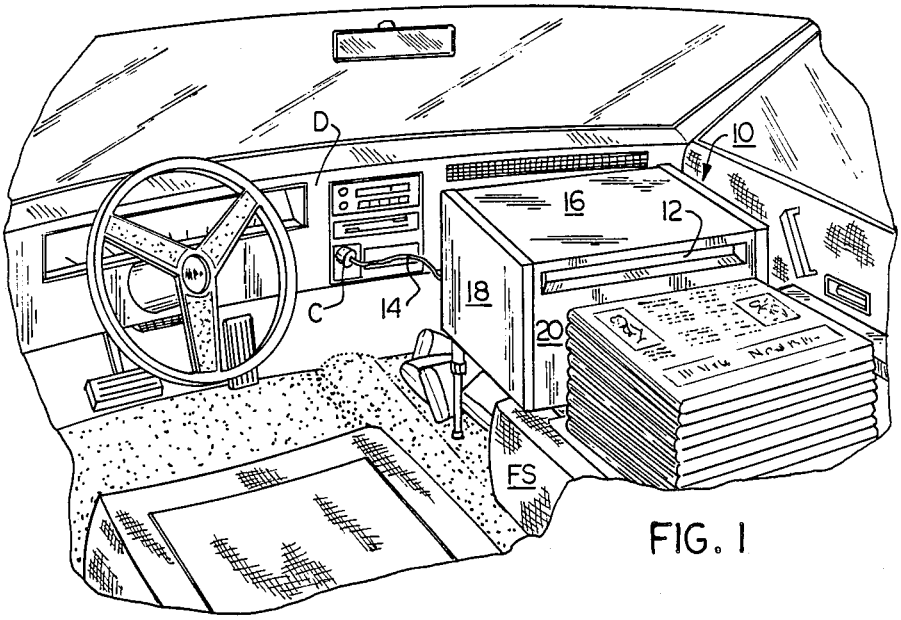
FIG. 1 is a perspective view illustrating the apparatus according to the present positioned in its intended environment on the front seat of a vehicle.

Looking first at FIG. 1, there is illustrated the present invention position in its intended environment. Toward this end in FIG. 1 there is illustrated the front seat portion of an automobile or other vehicle having a dashboard D and a partial showing of the front seat FS. Conventional vehicles are generally provided with a cigarette lighter C which is connected to the 12 volt DC battery source of the vehicle. As such, there exists access to a source of 12 volt DC voltage. The apparatus generally includes a housing 10 provided with a top wall 16, a front wall 20, a rear wall (not shown), a left-hand end wall 18, a right-hand end wall (not shown), and a bottom wall (not shown). An inlet 12 is provided in front wall 20 for the insertion of newspapers in their flat, half-folded state as they arrive from the newspaper office. An electrical cord 14 connects the mechanism within housing 10 with the cigarette lighter C for providing the 12 volt DC voltage to the apparatus.

It should be understood here that in use newspapers are stacked on the passenger side of the front seat opposite the front wall 20 so that an operator can merely lift the papers one at a time and insert them through the inlet slot 12. Obviously, the inlet slot 12 should be of such size as to receive the newspapers in their flat, half-folded condition. Once the mechanism within housing 10 folds and bags the newspapers, they are dropped through an opening (not shown) in the bottom wall where they accumculate on the front floor of the vehicle.

Turning now to FIG. 2, there is illustrated in a perspective showing the apparatus with all covers removed. Thus, there is a left-hand end plate 18' which forms substantially half of the support apparatus for the inner workings of the apparatus. Looking briefly at FIG. 5 a drive mechanism 22 is mounted on the inside surface of left-hand end wall 18'. In the preferred embodiment the drive mechanism 22 is a DC reversible motor operative from a 12 volt DC power supply. An example of such a type of motor is the XS-1153 drive motor manufactured by Merkle-Korff Industries of Des Plaines, Ill. The drive mechanism 22 includes the electric motor 24 which is connected by gears (not shown)

to an output shaft 26. In FIG. 2, the output shaft 26 extends in one direction through end wall 18' and has mounted thereto a pulley 28. Drive belt 30 extends around pulley 28 and is wound through various idler rolls 32, 33, 34, and 36 to define a vertical drive path extending between idler rolls 34, 36.

A folder bar 38, which extends transversely between walls 18' and 19', includes a terminal portion passing through a vertically extending slot 40 in side wall 18'. Slot 40 is generally parallel to and adjacent the vertical drive path established by the drive belt 30. The terminal end of folder bar 38 is secured to the drive belt 30 in any suitable manner so that upon downward movement of the drive belt caused by a clockwise rotation of pulley 28, the transverse folder bar 38 is caused to move downwardly. Upon reversal of motor 22, when the pulley 28 is rotated in a counterclockwise direction, a resulting upward movement of folder bar 38 is established. It is this upward and downward movement of drive bar 38 that folds the paper and polymeric film and activates the other mechanisms to be described hereinafter.

A mounting plate 42 is secured to end wall 18' in parallel adjacent relationship to slot 40. A plurality of switches 44, 46, and 48 are mounted on mounting plate 42, and a fourth switch 50 is mounted on the inner surface of end wall 18' adjacent the upper extremity of the path of movement of folder bar 38. Each of activating switches 44, 46, 48 and 50 include activating levers extending into the path of movement of folder bar 38.

On the outer surface of side wall 18' the uppermost switch 44 is a one-way, single lever type switch which is activated only on the downward movement of folder bar 38 to cease movement thereof maintaining it in a READY position. The lowermost switch 48 is a single lever microswitch positioned at the lower extremity of the folder bar stroke which, when activated, reverses the motor 22 causing the folder bar to then move upwardly. As the folder bar 38 moves upwardly it engages microswitch 46 which is a one-way, single lever type switch and only activated as the bar 38 moves upwardly. When switch 46 is activated, the heater for the sealing operation in activated through a timer relay which also deactivates the heater after a three second delay. The fourth, uppermost switch is a double lever microswitch and is mounted on the inside surface of side wall 18'. Switch 50 has the two-fold function of first indicating the upper end of the folder bar stroke, thereby deactivating motor 24. The second function is to initiate a timer for causing motor 24 to pause for a prescribed time period while the film is sealed and severed.

A fifth microswitch 130 is separately installed on the underside of the top cover 16 and includes an activating lever 132 which extends into the path of the newspaper as it is initially inserted into the apparatus. Switch 130 initiates the entire operation which is commenced by activating the drive motor 24.

Figure 4:
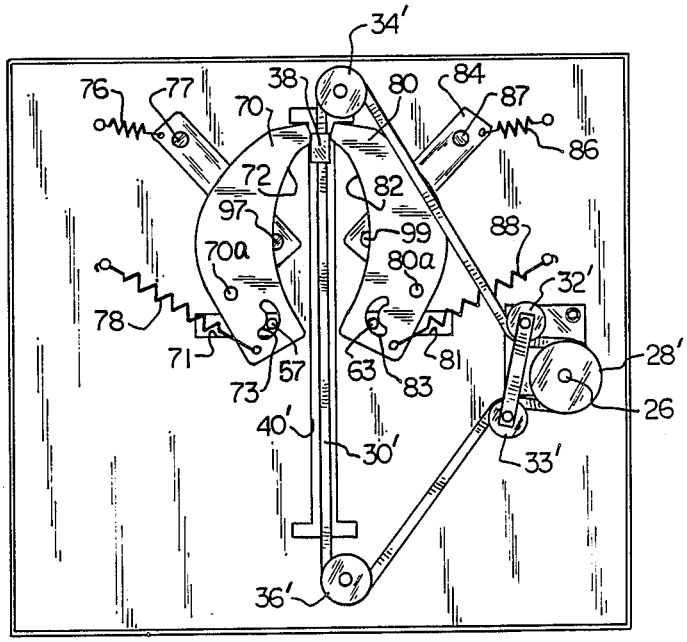
FIG. 4 is a side view looking at the right-hand side of the apparatus of FIGS. 1-3 with the folder bar at the uppermost position.
Figure 5:
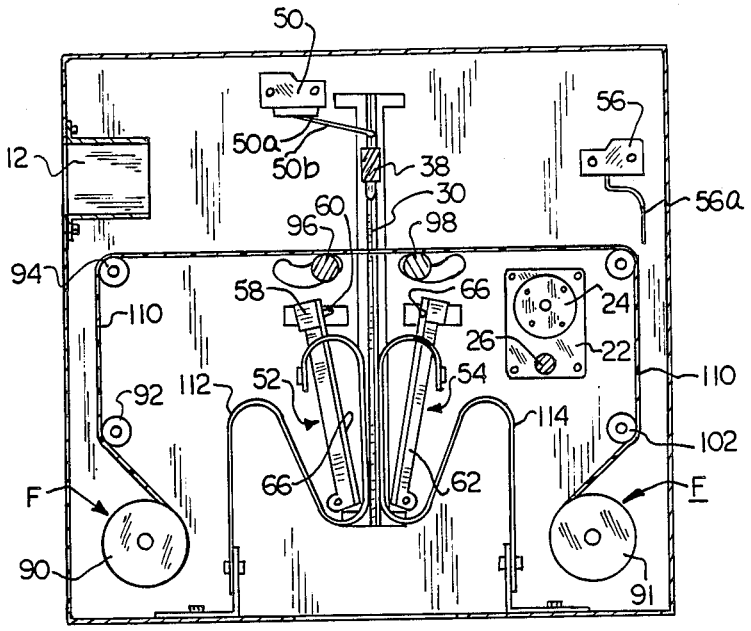
FIG. 5 is a sectional view taken substantially along lines 5—5 of FIG. 2.

Looking now at FIGS. 3–5, the right-hand side wall 19' is illustrated. The pulley 28', idler rolls 32',33',34', and 36', and the drive belt 30' are positioned on the right-hand side of the apparatus substantially the same as their counterparts 28, 32, 33, 34, and 36 appear on the left-hand end wall 18'. The drive shaft 26 extends in the opposite direction from motor 24 across the interior of the apparatus into operative engagement with the drive pulley 26'. Therefore, the driving of the folder bar 38 occurs from both ends so that the drive is even and consistent. Also, a slot 40' is provided in right-hand side wall 19' opposite the slot 40 in side wall 18' It should be noted here, however, that there is no mounting plate or microswitch arrangement on the right-hand side wall, as one set of controls is sufficient.

First of all, by reference to FIG. 5 the sealing frames 52, 54 are best illustrated. The front sealing frame 52 includes side arms 56 pivotally attached at the bottom and having the top bar 58 mounted between the upper extremities thereof to extend across the interior of the housing 10. A severing blade 60 is mounted on the face of top bar 58 for reasons to be described hereinafter. The opposite folder bar 54 also includes side arms 62 pivotally mounted at the lower end thereof and an upper top bar 64 extending between the upper extremities thereof. Both the side arms 56, 62 and the top bars 58, 64 are covered by a tetrafluoroethylene (Teflon) synthetic resin strip. In addition, the top bar 64 is provided with a resilient strip 66 beneath the Teflon covering to provide a resilient backing for the severing blade 60. When the frames 52, 54 are closed and heated the Teflon heats up and engages the polyethylene film to seal the marginal portions of the bag together. In the preferred embodiment the blade 60, which is also heated, simultaneously severs the top marginal portion of the bag at a point substantially centrally located of the sealed area. This frees the bagged newspaper to drop between the folder arms and out the bottom of the apparatus when the frames 52, 54 are opened. Simultaneously, the film is rejoined to again provide the continuous length thereof.

In order to activate the sealing frames 52, 54 each frame includes pins 57, 63 extending outwardly from arms 56, 62 through the adjacent end walls 18', 19'. The walls are slotted as illustrated in FIGS. 2 and 3 to provide for lateral reciprocating movement of the pins. The pins 57, 63 also extend through arcuate slots 73, 83 in the camming system to be described hereinafter.

The following description is made in reference to the right-hand end wall 19', however, the same apparatus is provided on the left-hand end wall 18', but, somewhat hidden by the electrical control switches. Therefore, it is believed that a clearer reference may be had by viewing FIG. 3 to describe the camming arrangement by which the sealing frame is activated.

Figure 6A:
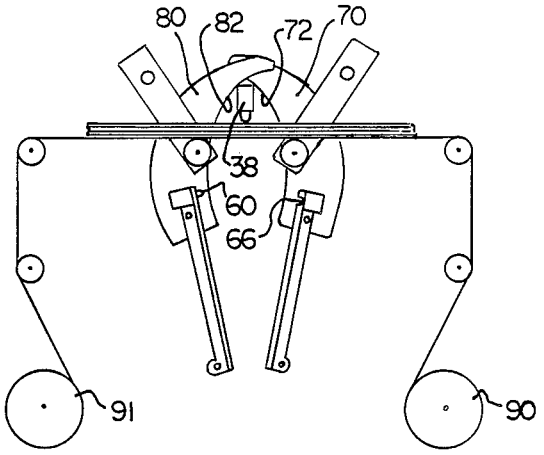
Figure 6B:
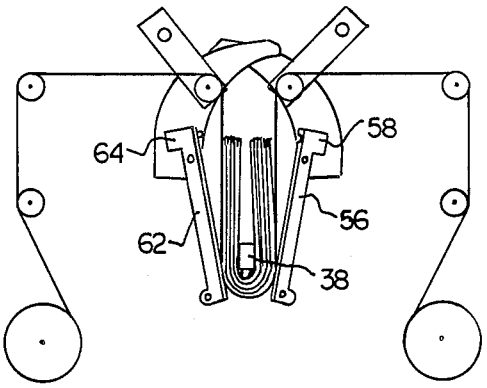
Figure 6C:
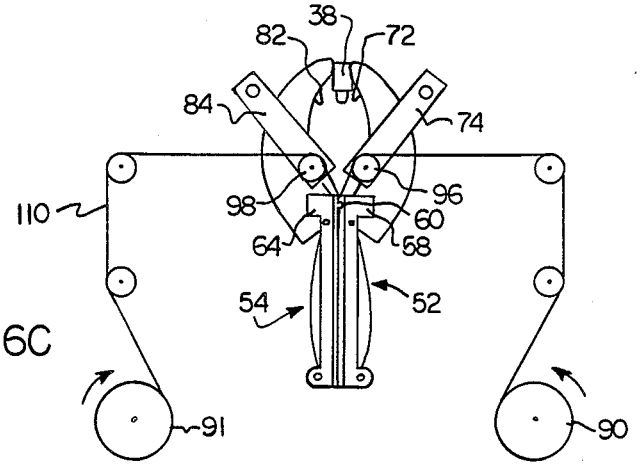

Turning now to a description of the camming action, and looking at FIG. 4, first and second pivotal arms 70, 80 are pivotally attached to pins **70*a*, 80*a*, which extend outwardly from side wall 19'. It should here be noted that the same arrangement is provided on the opposite end wall 18'. Arms 70, 80 include curved cam surfaces 72, 82 respectively at the upper ends thereof and arcuate slots 73, 83 adjacent the lower ends thereof. The frame arms 56, 62 include outwardly extending pins 57, 63 respectively which extend through openings 71, 81 in side wall 19'. So arranged, as the folder bar 38 moves upwardly to its uppermost position it engages the cam surfaces 72, 82 causing the pivotal arms 70, 80 to move to a parallel, vertically erect position (see FIG. 6*b*). This, in turn, urges the frames 52, 54 (through side arms 56, 62) to close to the sealed position (see FIG. 6*b*). As the folder bar 38 returns to its READY position springs 78, 88 return the first and second pivotal arms 70, 80 to their position illustrated in FIG. 3. As a result frames 52, 54 are also returned to their open, receiving position (FIG. 5**).

A second set of bias arms 74, 84 are also pivotally attached to studs 77, 87 on side wall 19'. The lower ends of bias arms 74, 84 are also pivotally attached to stud type extensions 97, 99 of idler rolls 96, 98. When a relatively thick newspaper or article is folded by folder bar 38 the bias arm arrangement described hereinabove allows the idler rolls 96, 98 to spread slightly. Once the paper has passed downwardly between idler rolls 96, 98 springs 76, 86 then return the idler rolls to their normal position. The slots 75, 85 provide clearance for the idler rolls 96, 98 to move slightly transversely as hereinabove described.

Looking now at FIG. 5 there is shown a cross-section of the interior of the folding and bagging apparatus 10. The microswitch 50 and its operation, as well as the folder bar 38 have been described sufficiently hereinabove. The microswitch 130 is centrally located between side walls 19, 19' and includes an activating lever 132 placed in the path of the newspaper as it is inserted into the apparatus. As mentioned hereinabove, this switch 130 activates the entire folding and bagging operation.

The film 110 is preferably a transparent, heat-sealable polyethylene film, although it should be recognized that other thermosetting or thermoplastic films could be utilized also. Film F is placed on two storage rolls 90, 91. Each of the rolls are journalled between the opposite side walls 19, 19' The film 110 extends continuously from roll 90 to roll 91 around idler rolls 92, 94, 96, 98, 100, and 102. As the folder bar moves downwardly the newspaper engages the film and pushes it down into the area between frames 52, 54. After the paper has been bagged and the film severed by heated knife edge 60, idler rolls 96, 98 tend to return to their uppermost position, causing the film 110 to lift away from the top bars 58, 64 in position to receiving a new paper.

A pair of opposed spring systems 112, 114 maintain the paper in a central location between the sealing frames 52, 54 and during the downward path thereof.

Turning now to FIG. 7 there is illustrated an electrical schematic. At the outset when the start switch 130 is engaged by movement of the newspaper into the apparatus the drive mechanism 22 is activated. The drive mechanism 22 causes the folder bar 38 to move downwardly simultaneously folding the newspaper and film 110. When the folder bar 38 engages the lower reverse switch 48, the drive mechanism 22 is reversed to drive the folder bar upwardly. As the folder bar passes the cutter-sealer time delay relay activating switch 46, the time delay is activated for a set time period. When the folder bar 38 reaches the upper position it engages both the upper motor reverse lever **50*a* and upper motor time delay relay 50*b* of switch 50. The upper motor time delay limit switch activates the drive motor time delay relay which causes the motor to pause for a set period of time, then returns the drive mechanism 22 to action. During this pause the sealing of the film 110 is effected, and the bagged paper is severed from the remainder of the film which is sealed together to reform the continuous length. After the set period, the upper motor reverse limit switch 50*a* is allowed to reverse the direction of the motor and thus the folding bar 38. The drive mechanism 22 then moves the folder bar downwardly to the READY position until the folder bar engages the stop limit switch 44, whereupon the cycle is completed and the motor shut off until the start switch 132** is again activated.

The aforementioned operating cycle is further described with reference to FIGS. *6a–6c* wherein the different steps in the operation are illustrated schematically.

While a preferred embodiment of the present invention has been described in detail hereinabove, it is apparent that various changes and modifications might be made without departing from the scope of the invention which is set forth in the accompanying claims.

What is claimed is:

1. Method for folding and bagging newspapers, magazines, and other paper articles comprising the steps of:

(a) forming a planar length of heat sealing thermosetting or thermoplastic film from a continuous length of said film along a feed path, said film being wider than the newspaper or other article to be folded and bagged;

(b) feeding the newspaper to a point in said feed path overlying said planar length of film;

(c) simultaneously and mechanically folding said newspaper and film along a fold line into a folded positioned with the newspaper being folded between opposed layers of said film, thereby making a pouch of said film with open sides and top, said folding step being accomplished by driving a folder bar from a first upper position above the center line of said newspaper as positioned in step (b) to a lower position below the position of the newspaper as defined in step (b);

(d) returning said folder bar from said lower position to a second upper position above said first upper position during the return movement;

(e) applying a force to press the side and top marginal areas of said film together directly responsive to the movement of said folder bar to said second upper position where said folder bar engages and activates a camming mechanism;

(f) applying sufficient heat thereto to seal said marginal areas of said film together as said side and top marginal areas of said film are pressed together;

(g) servering the top marginal edge of said opposed layers of film along an intermediate line to form a bag and to reform continuous length of film;

(h) ejecting said bagged newspaper and returning said continuous length of film to a position along said hold path in position for receiving another newspaper.

2. Apparatus for folding and bagging newspaper and other paper articles comprising:

(a) a housing with a top, bottom, and side walls with an inlet adjacent the top and an outlet in the bottom;

(b) means for positioning said housing in an operative position between the front seat of an automobile and the dash thereof with said outlet opening onto the floor of the passenger side of the automobile;

(c) mechanism means in said housing for folding and bagging newspapers placed in said inlet of said housing; and (d) said mechanism means including an electrical cord extending therefrom and means for connecting said electrical cord to the automobile battery.

3. The apparatus according to claim 2 and further including means for activating said mechanism means in response to the insertion of a newspaper in said inlet.

4. Apparatus for folding and bagging newspapers and other paper articles comprising:

(a) a housing comprising a front wall, a rear wall, a top wall, a bottom wall, and two end walls, said front wall including an inlet slot and said bottom wall having an exit opening therein, and a pair of parallel, spaced feed rolls journalled between said end walls;

(b) a horizontal feed path defined by a continuous length of heat sealable, polymeric film extending between said feed rolls, a portion of said horizontal feed path forming a folding station;

(c) a drive mechanism mounted on at least one of said end walls, a vertically reciprocal folder bar operatively connected to said drive mechanism and extending transversely across and above said length of film at a point substantially centrally located thereof at said folding station, said folder bar being movable by said drive mechanism between a first upper position above said continuous length of film and a lower position below said continuous length of film thus forming a pouch of said film having open sides and top and surrounding a folded newspaper;

(d) a pair of spaced opposed sealing frames, each sealing frame having side members and a top member, said frames being pivotally mounted at the lower end of said side members;

(e) a camming means operatively attached to said sealing frames and positioned in the path of said folder bar, said camming means being operable responsive to the upward movement of said folder bar past said upper position to a second upper position to move said sealing frames between an open receiving position and a closed, clamping position in sealing engagement with the side and top marginal portions of said film;

(f) means for heating said sealing frames;

(g) a cutting blade extending across at least one of said top members intermediate the upper and lower edges thereof for effecting a severance of said film above said newspaper and for reforming said continuous length of film; and (h) a reversible motor means mounted on at least one of said end walls and connected by an output shaft to said drive mechanism for moving said folder bar between said first and second upper positions and lower position.

5. The apparatus according to claim 4 wherein said feed path comprises:

(a) said opposed supply rolls carrying said continuous length of heat-sealable polymeric film therebetween, said rolls being spaced apart, said film being wider than the article to be wrapped;

(b) a pair of spaced apart idler rolls positioned one above each of said supply rolls;

(c) said continuous length of film extending from one supply roll, around the outside of one of said idler rolls, along a horizontal feed path, around the outside of the other idler roll, and back around the other supply roll.

6. The apparatus according to claim 4 wherein:

(a) said output shaft extends across said housing and through each of said side walls;

(b) said drive mechanism includes a pulley mounted on each end of said output shaft;

(c) a plurality of idler rolls rotatably mounted on each side wall in spaced arrangement to said pulley;

(d) a drive belt arranged adjacent each side wall around said pulley and idler roll arrangement;

(e) at least two of said idler rolls so arranged as to define a vertical drive path along which said drive belt extends;

(f) said folder bar being attached to the drive belt at a point along said vertical drive path.

7. The apparatus according to claim 6 wherein a plurality of control switches are mounted on one of said end walls adjacent said drive path for reversing and stopping said drive motor at prescribed times.

* * * * *